US008690143B2

(12) United States Patent
Nakamura

(10) Patent No.: US 8,690,143 B2
(45) Date of Patent: Apr. 8, 2014

(54) TURN-ASIDE FOR POST PROCESSING DEVICE WHEN MAXIMUM CAPACITY EXCEEDED

(75) Inventor: Shigeaki Nakamura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 164 days.

(21) Appl. No.: 13/372,667

(22) Filed: Feb. 14, 2012

(65) Prior Publication Data

US 2012/0205853 A1 Aug. 16, 2012

(30) Foreign Application Priority Data

Feb. 16, 2011 (JP) ..... 2011-030445

(51) Int. Cl.
*B65H 37/04* (2006.01)

(52) U.S. Cl.
USPC ..... 270/58.09; 270/58.08; 270/47

(58) Field of Classification Search
USPC ..... 270/38, 47, 58.08, 58.09
See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 5,289,251 | A * | 2/1994 | Mandel et al. | 399/407 |
| 5,765,824 | A * | 6/1998 | Kawano et al. | 270/58.11 |
| 6,219,503 | B1 * | 4/2001 | Miyake et al. | 399/85 |
| 6,241,234 | B1 * | 6/2001 | Saitoh et al. | 270/58.12 |
| 6,315,288 | B1 * | 11/2001 | Sugishima et al. | 271/303 |
| 6,332,606 | B1 * | 12/2001 | Seki | 270/59 |
| 7,318,584 | B2 * | 1/2008 | Kato et al. | 270/58.11 |
| 7,413,178 | B2 * | 8/2008 | Fujii et al. | 270/58.11 |
| 7,584,948 | B2 * | 9/2009 | Fujii et al. | 270/58.11 |
| 8,104,758 | B2 * | 1/2012 | Tanaka et al. | 270/58.11 |
| 8,292,285 | B2 * | 10/2012 | Yokoya et al. | 270/58.31 |
| 8,393,607 | B2 * | 3/2013 | Masunari et al. | 270/58.08 |
| 2002/0109289 | A1 | 8/2002 | Oikawa | |

FOREIGN PATENT DOCUMENTS

| | | | |
|---|---|---|---|
| JP | 10-194569 | A | 7/1998 |
| JP | 2002-321860 | A | 11/2002 |
| JP | 2004-292170 | | 10/2004 |

* cited by examiner

*Primary Examiner* — Patrick Mackey
(74) *Attorney, Agent, or Firm* — Morgan, Lewis & Bockius LLP

(57) ABSTRACT

A post-processing device includes a processing tray on which sheets are to be stacked, a transport portion for transporting, a sheet introduced through an introduction port, a turn-aside portion for turning aside the sheet to delay arrival of the sheet at the processing tray, and a delivery mechanism for delivering the sheets stacked on the processing tray to a delivery tray on a boundary between copies. When a remaining number of sheets of one copy unstacked on the processing tray exceeds a maximum number of stacked sheets that is an amount of sheets stackable on the processing tray, the delivery mechanism delivers a sheet stack of the one copy a plurality of times so as to avoid delivery of only one sheet on a last page of the one copy, and the turn-aside portion turns aside a sheet on a first page to be stacked after delivering the sheet bundle.

11 Claims, 10 Drawing Sheets

FIG.6 Proir Art

TURN-ASIDE FOR POST PROCESSING DEVICE WHEN MAXIMUM CAPACITY EXCEEDED

This application is based upon and claims the benefit of priority from the corresponding Japanese Patent Application No. 2011-030445 filed on Feb. 16, 2011, the entire contents of which are incorporated herein by reference.

BACKGROUND OF THE DISCLOSURE

1. Field of the Disclosure

The present disclosure relates to a post-processing device for performing post-processing on sheets. Further, the present disclosure relates to an image forming apparatus including a post-processing device. Further, the present disclosure relates to a control method for a post-processing device for performing post-processing on sheets.

2. Description of Related Art

An image forming apparatus such as a multifunction peripheral, a printer, a copying machine, and the like may be provided with a post-processing device. The post-processing device performs, for example, punching processing, stapling processing, and sorting processing when receiving printed sheets (paper) delivered from the image forming apparatus. Further, post-processing is performed on a plurality of sheets, and hence a tray for stacking the plurality of sheets may be provided inside the post-processing device. When the number of sheets (number of pages) of one copy exceeds the maximum number of stacked sheets of the tray, the post-processing cannot be performed on the whole sheets of one copy, with the result that desired post-processing cannot be executed in some cases.

To address this problem, there is known a sheet processing device capable of performing sorting processing even when the number of sheets of one copy exceeds the maximum number of stacked sheets. For example, there is known a sheet processing device including a collection tray for collecting sheets, a processing tray for temporarily stacking the sheets in the course to the collection tray, shifting means for shifting, on the processing tray, a collection position of the sheets in a width direction thereof, and capacity recognizing means for recognizing a stack amount of sheets stacked on the processing tray. The sheet processing device sorts the sheets for every predetermined number of sheets, and when the capacity recognizing means recognizes that the stack amount of the sheets on the processing tray exceeds a limit stack amount of the processing tray, the sheet processing device delivers the sheets stacked on the processing tray to the collection tray, and continues operation of the shifting means so that the position of the delivered sheets and the position of succeeding sheets are aligned on the processing tray until the number of the succeeding sheets reaches to a predetermined number. With this configuration, the sorting processing is adapted to the case where the number of sheets exceeds the limit stack amount of the processing tray.

Conventionally, in order to deliver the sheet bundle from the post-processing device, a printing speed of the image forming apparatus may be decreased (for example, a sheet feeding timing and an image formation start timing are delayed as compared to a normal case) so that an inter-sheet gap is increased. For example, in the conventional sheet processing device, in order to deliver the sheet bundle, a waiting time is provided on a boundary between copies. Further, in the conventional sheet processing device, in a case where the number of sheets of one copy exceeds the limit stack amount of the processing tray, when the sheets are stacked on the processing tray up to the limit stack amount, the printing is temporarily stopped for advancing the sheet.

As described above, in the conventional post-processing device, the printing in the image forming apparatus is temporarily stopped to deliver the sheet bundle. In other words, the inter-sheet gap between the sheets is increased as compared to the normal printing to ensure a period of time for delivery of the sheet bundle from the processing tray.

In order to maintain productivity (in order to maintain a normal inter-sheet gap), the post-processing device may be provided with a turn-aside portion for temporarily turning aside the sheet before the sheet is accumulated on the processing tray, to thereby delay the arrival of the sheet at the processing tray. However, when a plurality of copies are continuously printed, the following problem may arise in the post-processing device. That is, when the last page of one copy is turned aside, the last page of the one copy overlaps the first page of the succeeding copy, with the result that the last page of the one copy and the first page of the succeeding copy are transported with no difference in time. Consequently, the sheet bundle delivery (sorting) cannot be performed for each copy.

Therefore, in a case where the sorting is performed, when the sheet bundle is delivered at a point at which a page preceding the last page is stacked, the last page cannot be turned aside. In view of this, in order to ensure the period of time for delivery of the sheet bundle (in order to delay the arrival of the last page at the processing tray), the inter-sheet gap between the last page and the page preceding the last page always needs to be set larger than the normal case. Therefore, there is a problem in that even the turn-aside portion cannot maintain the productivity in some cases when the number of sheets of one copy exceeds the maximum number of stacked sheets of the processing tray.

The above-mentioned publicly known sheet processing device is not provided with the turn-aside portion. Hence, such a sheet processing device is not relevant to the problem of the decrease in productivity in the case of delivering only the sheet on the last page. Thus, the above-mentioned publicly known sheet processing device cannot solve the above-mentioned problem.

SUMMARY OF THE DISCLOSURE

In view of the above-mentioned problem, the present disclosure has an object to deliver sheets from a processing tray without decreasing productivity by avoiding delivery of only a sheet on the last page even when the number of sheets of one copy exceeds the maximum number of stacked sheets of the processing tray.

In order to achieve the above-mentioned object, according to one embodiment of the present disclosure, a post-processing device includes a processing tray on which sheets are to be stacked, a transport portion for transporting, toward the processing tray, a sheet introduced through an introduction port, a delivery mechanism for delivering the sheets stacked on the processing tray to a delivery tray on a boundary between copies, the delivery mechanism being configured to deliver, when a remaining number of sheets of one copy unstacked on the processing tray exceeds a maximum number of stacked sheets that is an amount of sheets stackable on the processing tray, a sheet bundle corresponding to the one copy a plurality of times so as to avoid delivery of only one sheet on a last page of the one copy, and a turn-aside portion for turning aside the sheet to delay arrival of the sheet at the processing tray, and then sending out the sheet to the processing tray, the turn-aside portion being configured to turn aside, when the remaining number of sheets of the one copy unstacked on the processing tray exceeds the maximum number of stacked sheets, a sheet on a first page to be stacked on the processing tray after delivering the sheet bundle.

According to the present disclosure, the delivery of only the sheet on the last page is avoided even when the number of sheets of one copy exceeds the maximum number of stacked sheets of the processing tray. Accordingly, it is possible to provide a post-processing device capable of delivering sheets from the processing tray without decreasing the productivity irrespective of the number of sheets of one copy, and to provide the post-processing device, an image forming apparatus.

Further features and advantages of the present disclosure will become apparent from the description of an embodiment given below.

DETAILED DESCRIPTION OF PREFERRED EMBODIMENT

Hereinafter, an embodiment of the present disclosure is described with reference to FIGS. 1 to 9. Note that, this embodiment is described by taking as an example a multifunction peripheral 100 (corresponding to an image forming apparatus) including a post-processing device 1. However, components, layouts, and other such elements described in this embodiment should not limit the scope of the present disclosure, and are merely used as examples for the sake of description. Note that, Throughout the present specification and the appended claims, the term "copy" used as a noun mostly denotes any of a number of sets of pages copied from the same original document, or any of a number of sets of printed matter printed based on (the same) image data transmitted from a computer to an image forming apparatus.

(Outline Structure of Main Body of Multifunction Peripheral 100)

Figure 1:
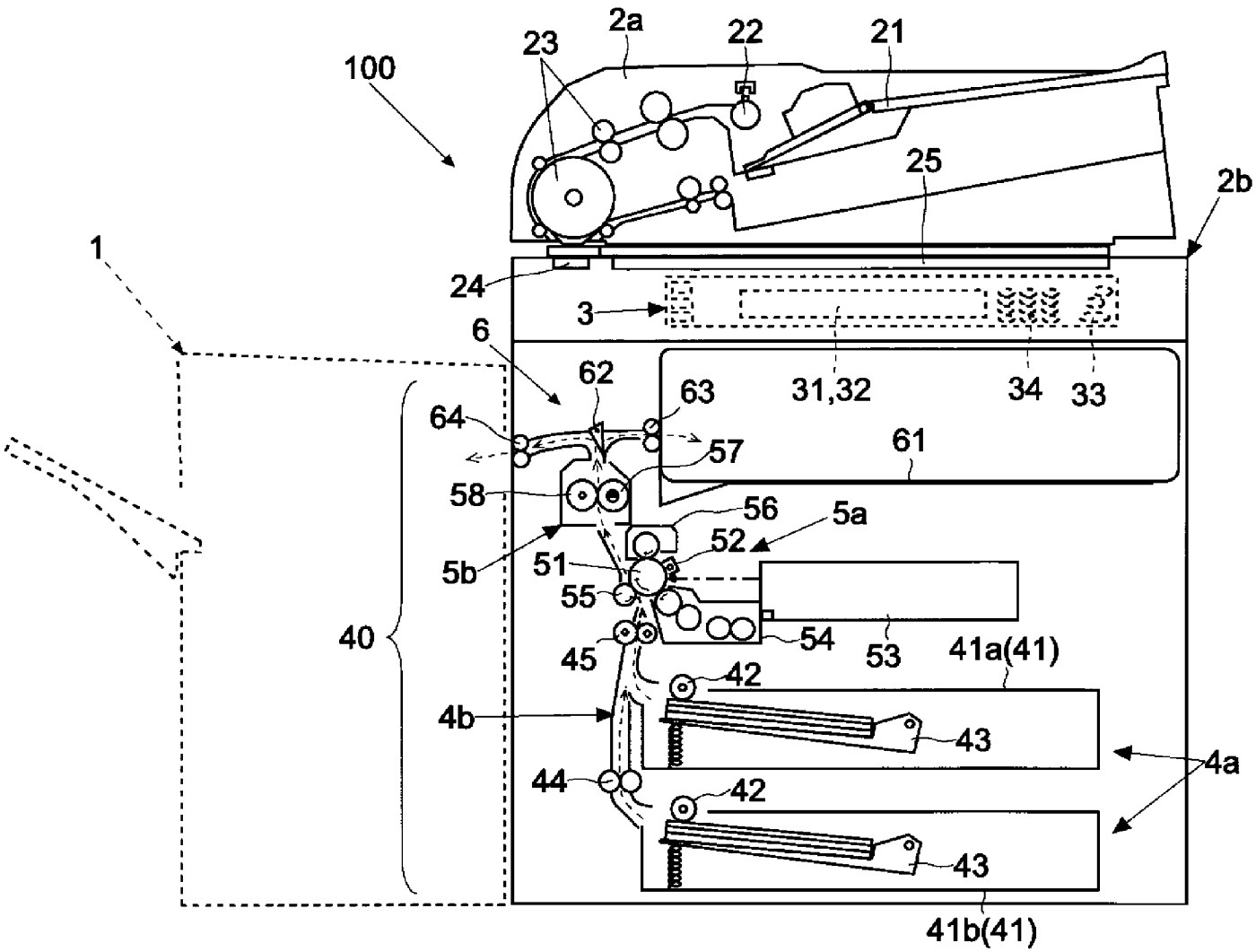
FIG. 1 is a schematic front sectional view illustrating an example of a multifunction peripheral.

First, reference is made to FIG. 1 to describe an outline of a main body of the multifunction peripheral 100 according to the embodiment of the present disclosure. FIG. 1 is a schematic front sectional view illustrating an example of the multifunction peripheral 100.

The multifunction peripheral 100 of this embodiment is provided with a document transport device 2*a* located at an uppermost level thereof. The document transport device 2*a* continuously transports documents stacked on a document placing tray 21 one by one to a reading position of an image reading section 2*b*. A document feeding roller 22 and a plurality of document transport roller pairs 23 to be brought into contact with an uppermost document transport the document to the reading position (position above a contact glass 24 for reading in transfer).

Further, the document transport device 2*a* is opened by being lifted upward about a fulcrum (not shown) provided on a depth side of the paper surface of FIG. 1. For example, a document such as a book can be placed on a contact glass 25 for reading in placement provided on an upper surface of the image reading section 2*b*.

The image reading section 2*b* reads a document, and generates image data. The contact glasses are provided on the upper surface of the image reading section 2*b*. Inside the image reading section 2*b*, there are provided a moving frame (including an exposure lamp and a mirror) (not shown) that moves in a horizontal direction (lateral direction of the multifunction peripheral 100) and optical members (not shown) such as a lens and an image sensor (for example, CCD). For example, when a document transported by the document transport device 2*a* is read, the moving frame is fixed below the contact glass 24 for reading in transfer, and reflected light from the document is introduced to the lens and the image sensor. Further, when a document placed on the contact glass 25 for reading in placement is read, the moving frame is caused to move in the horizontal direction, and the reflected light from the document is introduced to the lens and the image sensor.

The image reading section 2*b* uses those optical members to perform analog-to-digital conversion on an output value from each pixel of the image sensor that has received the reflected light from the document, and generates image data. Based on the read image data, the multifunction peripheral 100 can perform printing (copying function).

As indicated by the broken line in FIG. 1, an operation panel 3 is provided on a front surface side of the image reading section 2*b* (on an upper portion of the front surface of the multifunction peripheral 100). The operation panel 3 functions as an input section for performing settings on printing such as copying, and displays various kinds of information. The operation panel 3 includes a liquid crystal display portion 31 for displaying a status of the multifunction peripheral 100 and various kinds of messages. The liquid crystal display portion 31 is capable of displaying one or more keys for selecting functions, performing settings, inputting characters, and performing other operations. Further, a touch panel portion 32 (for example, a resistive film system) is provided to the liquid crystal display portion 31. The touch panel portion 32 is provided so as to detect a position and coordinates of a portion depressed by the liquid crystal display portion 31. The operation panel 3 is also provided with a start key 33 for instruction to start executing various kinds of functions such as copying and image data transmission, and a numerical keypad portion 34 for inputting numerals and the like.

When a setting screen or a key displayed on the liquid crystal display portion 31 is depressed, it is possible to issue, on the operation panel 3, instructions to perform copying, image data transmission, and settings on printing to be performed based on image data accumulated in the multifunction peripheral 100, and to execute a job. In addition, when the numerical keypad portion 34 of the operation panel 3 is depressed, it is possible to set the number of print copies.

In addition, the operation panel 3 receives operations of the post-processing device 1 and settings on operations thereof. A user may use the operation panel 3 to perform settings on processing to be performed by the post-processing device 1. For example, the user may perform settings on sorting processing, stapling processing, and punching processing for jobs involving a plurality of copies. For example, the operation panel 3 displays a setting screen on the sorting, and receives settings on items regarding, for example, whether or not to perform sorting while delivering a sheet bundle for each of the copies. In actual jobs, the multifunction peripheral 100 and the post-processing device 1 operate in accordance with the settings.

Further, an engine section 40 related to image formation, including a sheet feeding portion 4*a*, a transport portion 4*b*, an image forming portion 5*a*, and a fixing portion 5*b*, is provided inside the main body of the multifunction peripheral 100.

The sheet feeding portion 4*a* accommodates and feeds sheets for image formation. The sheet feeding portion 4*a* includes two cassettes 41 (41*a* and 41*b*) in total. The cassettes 41 (41*a* and 41*b*) are stacked in a vertical direction, and are each insertable and removable. The sheet feeding portion 4*a* accommodates a plurality of (for example, approximately 500 to 1,000) stacked sheets of different kinds (for example, plain paper, copying sheet, and recycled paper) and different sizes (for example, A4, A3, B4, B5, and letter size). Note that, the respective cassettes 41 (41*a* and 41*b*) have the same structure, and hence the same members are denoted by the same reference symbols.

Sheet feeding rollers 42 are provided to the respective cassettes 41 (41*a* and 41*b*). Each sheet feeding roller 42 is driven to rotate in order to supply sheets. Further, sheet placing plates 43 for placing sheets are provided inside the respective cassettes 41 (41*a* and 41*b*). Each sheet placing plate 43 is urged upward, and an uppermost sheet is therefore held in contact with the sheet feeding roller 42.

Next, the transport portion 4*b* is a passage along which the sheet is to be transported inside the apparatus. The transport portion 4*b* is provided with a transport roller pair 44 to be driven to rotate when the sheet is transported. Further, the transport portion 4*b* is provided with, for example, a registration roller pair 45 that causes the sheet being transported to wait before the image forming portion 5*a* and sends out the sheet at a timing corresponding to formation of a toner image.

The image forming portion 5*a* forms an image (toner image) based on the image data on the sheet that is fed from the sheet feeding portion 4*a*, and transfers the toner image onto the sheet being transported. Note that, image data on a document acquired by the image reading section 2*b* and image data transmitted from a computer 200 (see FIG. 3) which is connected to the multifunction peripheral 100 are to be used for printing. The image forming portion 5*a* includes a photosensitive drum 51 supported so as to be driven rotatably in a direction indicated by the arrow illustrated in FIG. 1, a charging device 52, an exposure device 53, a developing device 54, a transferring roller 55, and a cleaning device 56, which are arranged around the photosensitive drum 51.

Next described are toner image formation and transfer process. The photosensitive drum 51 to be driven to rotate in a predetermined direction is provided substantially at a center of the image forming portion 5*a*. The photosensitive drum 51 is charged to a predetermined potential by the charging device 52. The exposure device 53 outputs a laser beam based on the image data, and scan-exposes a surface of the photosensitive drum 51 to form an electrostatic latent image corresponding to the image data. The developing device 54 develops the electrostatic latent image formed on the photosensitive drum 51 by supplying toner thereto. The transferring roller 55 is held in press contact with the photosensitive drum 51 to form a nip therebetween. Then, the registration roller pair 45 causes the sheet to enter the nip at a suitable timing. When the sheet and the toner image enter the nip, a predetermined voltage is applied to the transferring roller 55. In this manner, the toner image formed on the photosensitive drum 51 is transferred onto the sheet. After the transfer, the cleaning device 56 removes residual toner and the like from the photosensitive drum 51.

The fixing portion 5*b* fixes the toner image transferred onto the sheet. The fixing portion 5*b* according to this embodiment mainly includes a heat roller 57 incorporating a heating element and a pressure roller 58. The heat roller 57 and the pressure roller 58 are held in press contact with each other to form a nip therebetween. When the sheet passes through the nip, the toner is heated and fused, and the toner image is fixed onto the sheet.

The sheet having passed through the fixing portion 5*b* is sent out to a sheet delivery portion 6. The sheet delivery portion 6 sends out the printed sheet to an internal delivery tray 61 of the main body or the post-processing device 1. The sheet delivery portion 6 sorts the sheet into a delivery destination that is set as default (for example, delivery toward the internal delivery tray 61 is set as default) or designated through the operation panel 3. For sorting of the sheet into a desired delivery destination, a pivotable claw 62 is provided.

The pivotable claw 62 pivots so as to guide the sheet to the delivery destination. A delivery roller pair 63 to be driven to rotate is provided so as to deliver the sheet to the internal delivery tray 61. A delivery roller pair 64 to be driven to rotate is also provided so as to deliver the printed sheet toward the post-processing device 1. FIG. 1 illustrates a sheet delivery direction by the arrows indicated by the broken lines. Further, FIG. 1 illustrates an example of the pivotable claw 62 in a state of delivering the sheet in a direction of the post-processing device 1.

(Post-Processing Device 1)

Figure 2:
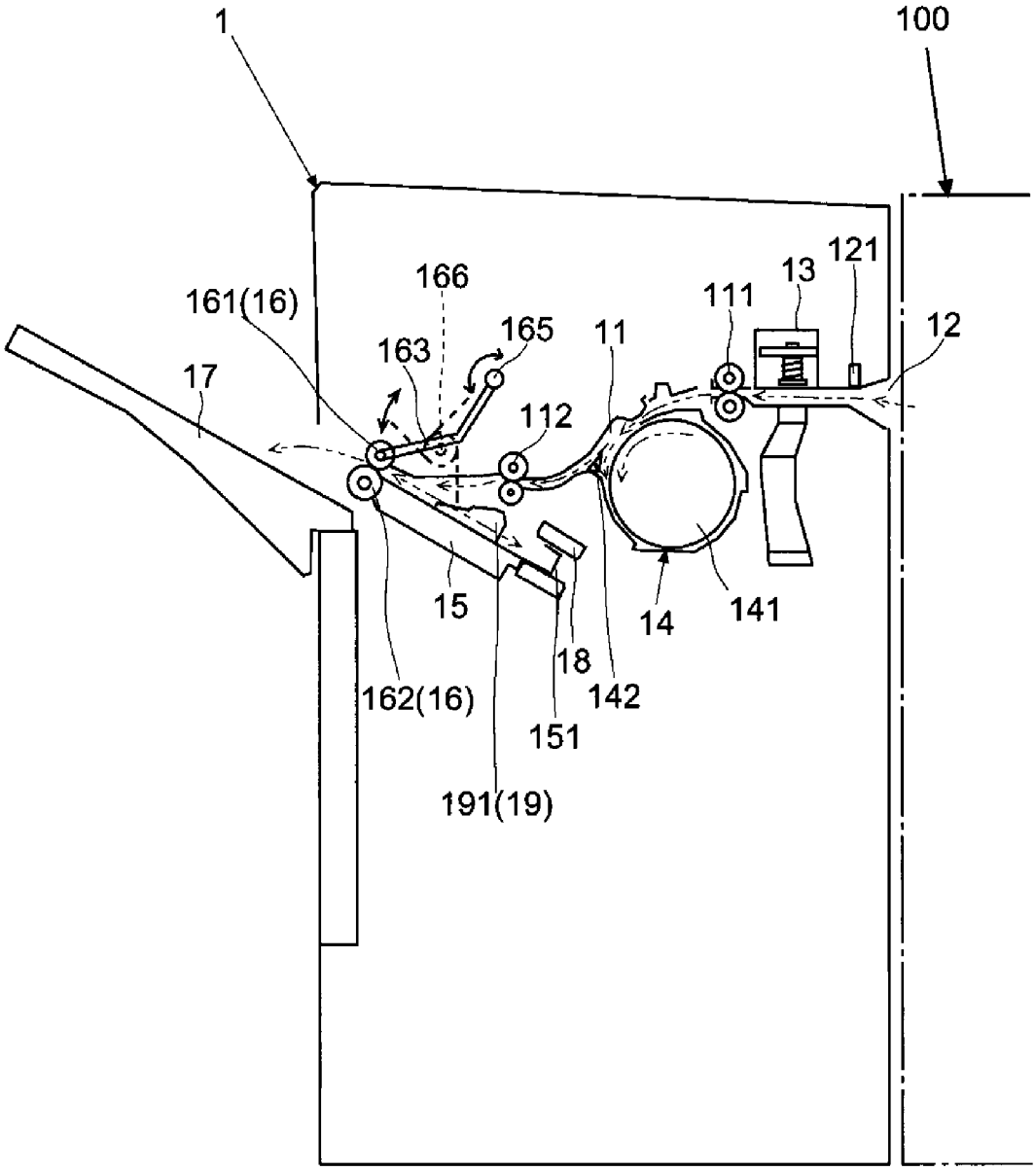
FIG. 2 is a schematic front sectional view illustrating an example of a post-processing device.

As indicated by the broken line in FIG. 1, the post-processing device 1 for performing post-processing on the printed sheet is mounted onto the multifunction peripheral 100 of this embodiment. Thus, reference is made to FIG. 2 to describe an example of the post-processing device 1 according to the embodiment of the present disclosure. FIG. 2 is a schematic front sectional view illustrating the example of the post-processing device 1. Note that, FIG. 2 illustrates an example of a sheet transport path by two-dot chain lines.

The post-processing device 1 is connected to the multifunction peripheral 100. A transport portion 11 is provided inside the post-processing device 1. The transport portion 11 is provided with transport roller pairs 111 and 112. The transport roller pairs 111 and 112 are driven to rotate to transport the introduced sheet toward a processing tray 15. In an order of the transport path for the printed sheet, an introduction port 12, a punching portion 13, a turn-aside portion 14, the processing tray 15, a delivery mechanism 16, and a delivery tray 17 are provided to the post-processing device 1.

The printed sheet delivered from the multifunction peripheral 100 is introduced into the post-processing device 1 through the introduction port 12 provided in an upper portion of a right side surface of the post-processing device 1. An introduction sensor 121 for detecting the introduction of the sheet into the post-processing device 1 is provided in the vicinity of the introduction port 12. The introduction sensor 121 is used to recognize the introduction of the sheet into the post-processing device 1.

The punching portion 13 is provided in the vicinity of the most upstream of the transport portion 11 inside the post-processing device 1. The punching portion 13 performs punching processing on the sheet. The turn-aside portion 14 is provided between the processing tray 15 and the punching portion 13.

The turn-aside portion 14 includes a turn-aside drum 141 to be driven to rotate. The turn-aside portion 14 turns aside the sheet, which is transported and to be temporarily turned aside by the post-processing device 1, in such a manner that the sheet is rolled around the turn-aside drum 141. In other words, the turn-aside portion 14 delays a time at which the sheet arrives at the processing tray 15. Then, the turn-aside portion 14 sends out, in a direction of the processing tray 15, the sheet at a timing synchronized with that of a succeeding sheet (sheet on a succeeding page), or alternatively, the sheet so as to overlap the succeeding sheet. Without the turn-aside portion 14, an inter-sheet gap needs to be set larger than a normal case to delay the arrival of the succeeding sheet at the processing tray 15 when the delivery processing for the sheet bundle from the processing tray 15 is performed. However, after the delivery of the sheet bundle, the turn-aside portion 14 turns aside the sheet on the first page (transported for the first time) to be placed on the processing tray 15, and hence it is possible to continue the printing and the sheet delivery by the post-processing device 1 until the end with the normal inter-sheet gap. In other words, there is no need to perform midway processing of increasing the inter-sheet gap as compared to the normal case when continuously printing the sheets.

The normal inter-sheet gap herein refers to an interval between sheets, which is defined in conformity to the specification based on a sheet transport speed in the post-processing device 1 and the multifunction peripheral 100, a paper size, and desired printing productivity (for example, expressed in the unit of page per minute (PPM)). The normal inter-sheet gap differs depending on the model of the image forming apparatus.

A switching claw 142 is provided so as to switch between the operation of turning aside the sheet to the turn-aside portion 14 and the operation of transporting the sheet directly to the processing tray 15 without turning aside the sheet. When the sheet is turned aside to the turn-aside portion 14, the switching claw 142 pivots in a direction in which the sheet is guided to the turn-aside portion 14. On the other hand, when the sheet is not turned aside to the turn-aside portion 14, the switching claw 142 pivots in a direction in which the sheet is guided to the processing tray 15.

The processing tray 15 temporarily stacks the sheets to be sorted or stapled as a stack of sheets. The processing tray 15 is inclined so that its downstream side in the sheet transport direction is raised as compared to the upstream side in the sheet transport direction. Further, the delivery mechanism 16 is provided to the end of the processing tray 15 on the downstream side in the sheet transport direction (upstream side of the delivery tray 17). The delivery mechanism 16 includes an upper roller 161 and a lower roller 162.

As illustrated in FIG. 2, the upper roller 161 of the delivery mechanism 16 is movable in a vertical direction. An arm 163 is connected to the upper roller 161 so as to move the upper roller 161. The arm 163 is connected at its other end to a rotary shaft 165 rotatable by an arm operating motor 164 (see FIG. 3). The arm operating motor 164 performs forward and reverse rotation. Accordingly, the upper roller 161 can be separated from the lower roller 162. Further, the upper roller 161 can be urged so as to be pressed in a direction of the lower roller 162.

Description is given of an example of procedures of stacking sheets on the processing tray 15 and delivering the sheets to the delivery tray 17. For example, when the sheets are delivered to the delivery tray 17 without stacking the sheets on the processing tray 15 (without performing the post-processing such as sorting and stapling), the upper roller 161 and the lower roller 162 are held in contact with each other. Then, the upper roller 161 and the lower roller 162 are driven to rotate in a direction in which the sheets are delivered to the delivery tray 17. In other words, when the processing using the processing tray 15 is not performed, the rollers of the delivery mechanism 16 rotate in a direction in which the printed sheets are continuously delivered to the delivery tray 17.

Next, description is given of a procedure of delivering sheets when the sheets are stacked on the processing tray 15. When the first sheet is stacked on the processing tray 15, the arm operating motor 164 operates so that the upper roller 161 and the lower roller 162 are separated from each other. Part (downstream end portion) of the first sheet to be stacked on the processing tray 15 is temporarily introduced between the upper roller 161 and the lower roller 162. Then, the sheet descends in an obliquely downward direction of the processing tray 15 due to its own weight. Note that, in place of the configuration in which the sheet descends due to its own weight, there may be employed a configuration in which, when the first sheet is stacked on the processing tray 15, a paddling portion 166 described later rotates to send the sheet downward of the processing tray 15. A stopper 151 is provided on a lower side of the processing tray 15. A lower end of the sheet abuts against the stopper 151. Even after the descending, part of the sheet is held in contact with the lower roller 162. Note that, a stapling portion 18 for stapling the sheet bundle is provided in the vicinity of the stopper 151. For example, the stapling portion 18 drives a staple into a corner portion of the sheet.

When the second or subsequent sheet is stacked on the processing tray 15, for example, the lower roller 162 and the upper roller 161 are separated from each other. The paddling portion 166 is provided so as to send the paper downward of the processing tray 15. Note that, in FIG. 2, the paddling portion 166 is indicated by the broken line. When the sheet is stacked on the processing tray 15, the paddling portion 166 rotates to send the sheet downward of the processing tray 15. Accordingly, alignment in a sheet length direction is performed on the processing tray 15.

Note that, the processing tray 15 is provided with a pair of regulating guides 191 for regulating the sheets in a width direction thereof (in a depth direction of the post-processing device 1 in front view). The regulating guides 191 are rocked by a rocking mechanism 192 (see FIG. 3) such as a motor and gears. The regulating guides 191 are rocked in the depth direction of the post-processing device 1 in front view (direction perpendicular to the delivery direction of the sheet bundle). Accordingly, the regulating guides 191 align the sheets on the processing tray 15 in the width direction thereof. Further, when the sheet bundle corresponding to one copy is delivered while being sorted, the regulating guides 191 are moved by the rocking mechanism 192 to shift the position of the sheet bundle on the processing tray 15. Accordingly, the position of delivery of the sheet bundle to the delivery tray 17 is shifted for each copy so that the sorting is performed for each copy.

When the sheet bundle is delivered from the processing tray 15, the upper roller 161 is urged in the direction of the lower roller 162. Then, the upper roller 161 and the lower roller 162 nip the stacked sheet bundle. Then, the upper roller 161 and the lower roller 162 rotate so as to deliver the nipped sheet bundle in a direction of the delivery tray 17. Accordingly, the stacked or stapled sheet bundle is delivered by the delivery mechanism 16.

The delivered sheet bundle is accumulated on the delivery tray 17. Note that, the delivery tray 17 is urged upward, and as the sheet bundle is further placed thereon, the delivery tray 17 descends along a guide. Accordingly, it is possible to deliver many sheet bundles to the delivery tray 17.

(Hardware Configuration of Multifunction Peripheral 100)

Figure 3:
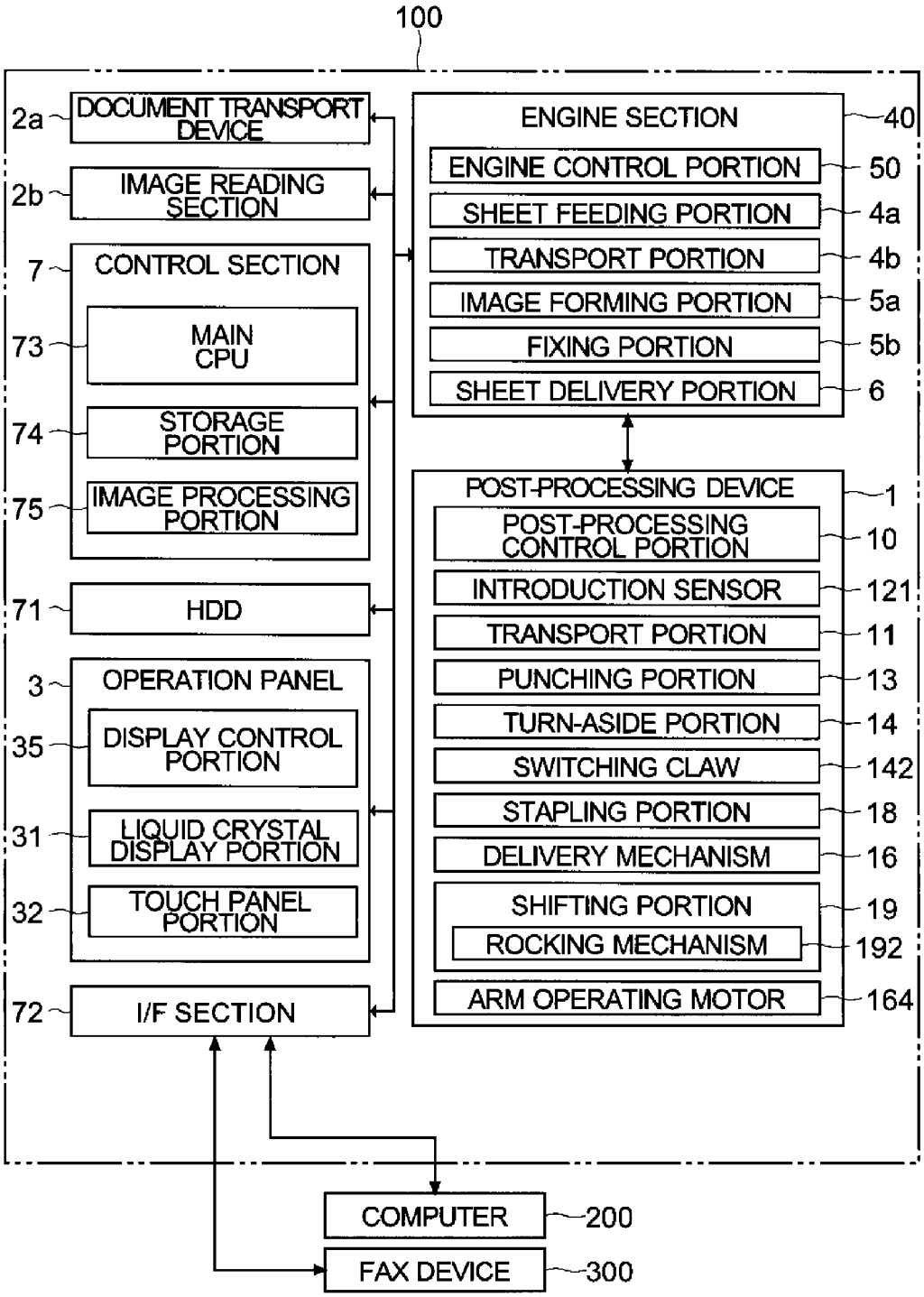
FIG. 3 is a block diagram illustrating an example of a hardware configuration of the multifunction peripheral.

Next, reference is made to FIG. 3 to describe a hardware configuration of the multifunction peripheral 100 according to the embodiment of the present disclosure. FIG. 3 is a block diagram illustrating an example of the hardware configuration of the multifunction peripheral 100.

As illustrated in FIG. 3, the multifunction peripheral 100 according to this embodiment includes a control section 7 (control board) having a combination of various elements, circuits, and the like. The control section 7 is communicably connected to an HDD 71, an I/F section 72, the image reading section 2*b*, the document transport device 2*a*, the operation panel 3, the engine section 40, and the like. The control section 7 performs communications with the respective sections to control operations of the respective sections and obtain information therefrom.

The control section 7 includes, for example, a main CPU 73, a storage portion 74, and an image processing portion 75. The main CPU 73 is a processor of the control section 7, and performs processing and control based on data and programs stored in the storage portion 74. The storage portion 74 is a combination of, for example, a nonvolatile storage device (for example, flash ROM) and a volatile storage device (for example, RAM). The storage portion 74 stores the data and programs required for various kinds of control such as execution of a job. Note that, the HDD 71 can be connected to the control section 7 as a mass storage device, and the control section 7 can use the HDD 71 as one of the storage devices. For example, the HDD 71 stores image data and the like in addition to the data and programs required for the various kinds of control.

The image processing portion 75 performs image processing on image data generated by the image reading section 2*b* or image data input from an external portion. For example, the image processing portion 75 is configured of an ASIC dedicated to image processing or a memory for image processing. The image data that has undergone the image processing can be sent to the exposure device 53 for the printing (copying function and printer function), and can be stored in the HDD 71 (scanner function). Further, the image data that has undergone the image processing can be transmitted from the I/F section 72 described later to the external portion (computer 200, FAX device 300, or the like) (scanner function and FAX function). Note that, the image processing portion 75 may be functionally implemented by the main CPU 73 and the storage portion 74. Further, the image processing that can be performed by the image processing portion 75 greatly varies from enlargement/reduction processing to density changing and the like, and details thereof are omitted on the assumption that publicly known image processing can be executed.

The control section 7 is connected to the I/F section 72. The I/F section 72 is an interface for performing communications with the external computer 200 (for example, personal computer or server) and the external FAX device 300 via a network, a line, a cable, or the like. Therefore, the I/F section 72 includes various connectors and a circuit, an element, a controller, a modulation/demodulation circuit, and the like for the communications. By the communications performed via the I/F section 72, the control section 7 can receive data for printing from the external computer 200 or the external FAX device 300 and can transmit image data to the external computer 200 or the external FAX device 300.

The operation panel 3 is provided with regard to the inputting and displaying of settings on the multifunction peripheral 100. Provided in the operation panel 3 is a display control portion 35 that controls actual operations of the operation panel 3 in response to an instruction from the control section 7. The display control portion 35 is configured of, for example, a CPU and a memory. The display control portion 35 controls recognition of operations for the operation panel 3 and display for the operations. For example, the display control portion 35 performs display control for the liquid crystal display portion 31. Further, the display control portion 35 performs recognition of coordinates of a position depressed on the touch panel portion 32 and recognition of a key depressed in accordance therewith. Further, the display control portion 35 recognizes operations for various hardware keys including the numerical keypad portion 34 and the start key 33.

Next, the engine section 40 is provided with regard to the printing performed on the multifunction peripheral 100. The engine section 40 includes the sheet feeding portion 4*a*, the transport portion 4*b*, the image forming portion 5*a*, and the fixing portion 5*b* that are described above. In addition, an engine control portion 50 is provided inside the engine section 40 so as to control actual operations of the respective portions of the engine section 40 in response to an instruction from the control section 7. The engine control portion 50 is configured of, for example, a CPU and a memory. The engine control portion 50 performs control of members included in the engine section 40, such as sheet feeding, transport, toner image formation, and temperature control of the fixing portion 5*b*.

Further, the control section 7 causes the engine control portion 50 of the engine section 40 to relay an operation instruction, to thereby give the operation instruction for the post-processing device 1. The engine control portion 50 of the engine section 40 may also give the operation instruction for the post-processing device 1. In this embodiment, the engine section 40 supervises the control related to the printing, and the post-processing device 1 is regarded as being dependent on the engine section 40.

A post-processing control portion 10 is provided inside the post-processing device 1 so as to control actual operations of the post-processing device 1 in response to an instruction from the engine control portion 50. The post-processing control portion 10 is also configured of, for example, a CPU and a memory.

The post-processing control portion 10 controls operations and processing of the members included in the post-processing device 1. Specifically, the post-processing control portion 10 controls the sheet introduction detection, operation of the punching portion 13, sheet transport, sheet stacking, operation of the stapling portion 18, operation of the turn-aside portion 14, operation of the delivery mechanism 16, operation of a shifting portion 19, and the like. For example, the introduction sensor 121 is connected to the post-processing control portion 10. The introduction sensor 121 is, for example, a transmission optical sensor. Based on a change in output from the introduction sensor 121 (change in value of an output voltage), the post-processing control portion 10 recognizes the transport of the sheet to the post-processing device 1, passage of the sheet through the introduction port 12, and the like.

(Settings on Sorting)

Figure 4:
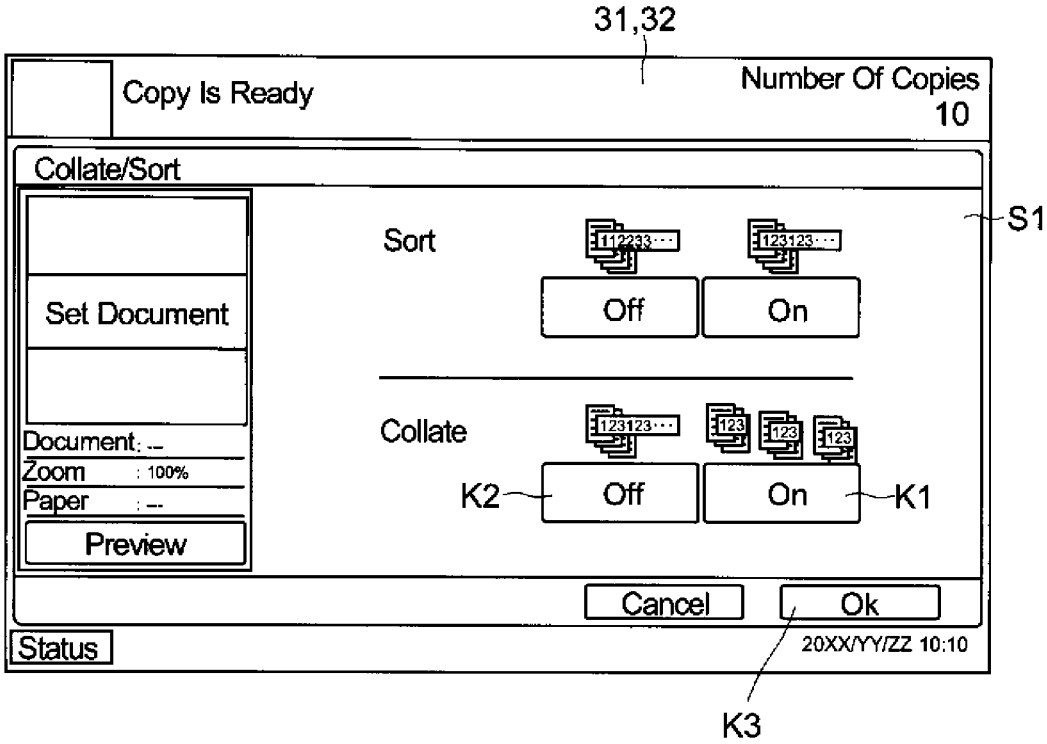
FIG. 4 is an explanatory diagram illustrating an example of a sort setting screen displayed on an operation panel.

Next, reference is made to FIG. 4 to describe an example of settings on the sorting, which are to be performed on the operation panel 3 of the multifunction peripheral 100 according to the embodiment of the present disclosure. FIG. 4 is an explanatory diagram illustrating an example of a sort setting screen S1 displayed on the operation panel 3.

The user may wish to print a plurality of copies of the same document so as to create handouts. In the case of printing a plurality of copies, when the copies are delivered to the delivery tray 17 while being collated and sorted, the user does not need to sort the respective copies himself/herself. The post-processing device 1 of this embodiment is capable of performing the sorting processing. For example, when copying is performed to obtain a plurality of copies of a document with a plurality of pages, the operation panel 3 receives settings on the sorting.

Specifically, the operation panel 3 (liquid crystal display portion 31 of the operation panel 3) displays the sort setting screen S1 so as to perform settings on the sorting. On the sort setting screen S1, settings can be performed on the sorting to be performed by the post-processing device 1 (whether or not to deliver sheet bundles while shifting the position for each copy). When the sorting is performed, the user depresses a sort enabling key K1 (key indicating "ON"). On the other hand, when the sorting is not performed, the user depresses a sort disabling key K2 (key indicating "OFF").

When an OK key K3 is depressed under a state in which the sort enabling key K1 is depressed, a notification that the sorting is to be performed is issued from the operation panel 3 to the control section 7. Then, the control section 7 notifies the post-processing control portion 10 via the engine control portion 50 that the sorting is to be executed at the time of copying. Accordingly, the post-processing control portion 10 recognizes that the sorting is to be executed.

In the sorting, the post-processing control portion 10 controls, before the sheet bundle is delivered, the shifting portion 19 to shift the position of the sheet bundle on the processing tray 15 for each copy. Then, the delivery mechanism 16 of the post-processing device 1 delivers the sheet bundle under the state in which the position of the sheet bundle is shifted. Accordingly, the sheet bundle is sorted. Note that, when the sorting is not executed and the stapling processing is not executed, the post-processing control portion 10 delivers the sheets one by one to the delivery tray 17.

In the above, description has been given of the example in which the operation panel 3 is used to perform the settings on the sorting. However, the multifunction peripheral 100 of this embodiment is usable as a printer, and hence a similar setting screen may be displayed on the computer 200 for performing the printing by transmitting image data to the multifunction peripheral 100. For example, the setting screen on the sorting may be displayed by driver software installed in the computer 200 so as to use the multifunction peripheral 100. Further, contents of the settings on the sorting performed on the computer 200 may be transmitted to the multifunction peripheral 100 so that the sorting is performed also in the printing to be performed based on image data from the computer 200.

(Shifts in Sorting)

Figure 5:
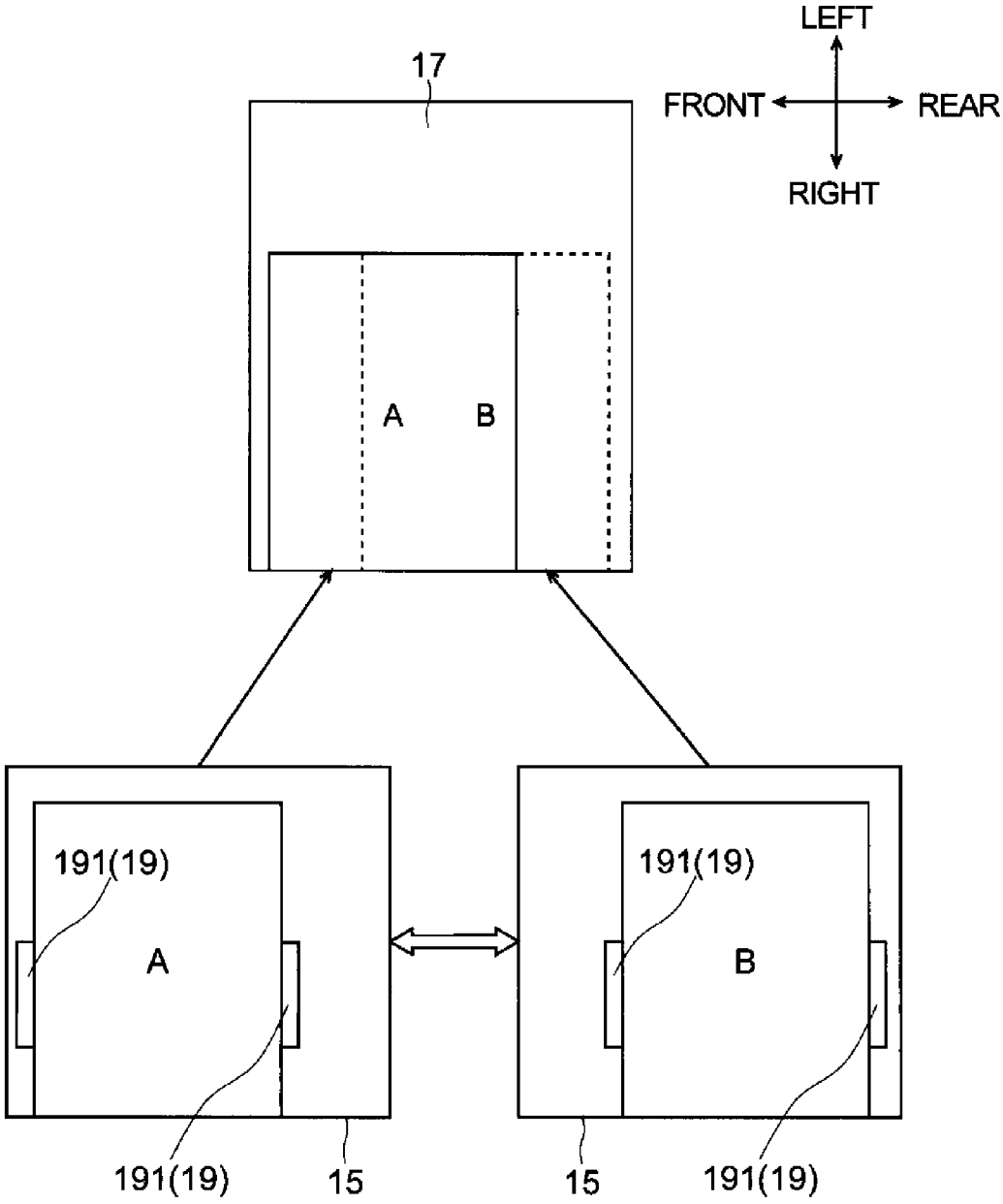
FIG. 5 is an explanatory diagram illustrating an example of shifts of a shifting portion at the time of sorting.

Next, reference is made to FIG. 5 to describe an example of shifts of the shifting portion 19 at the time of sorting according to this embodiment. FIG. 5 is an explanatory diagram illustrating an example of shifts of the shifting portion 19 at the time of sorting.

First, FIG. 5 is a schematic view of the processing tray 15 and the delivery tray 17 as viewed from above, illustrating an example of the positions of the sheet bundle at the time of delivery performed between the processing tray 15 and the delivery tray 17. Note that, the "front" in the cross arrow of FIG. 5 represents the front side of the post-processing device 1, the "rear" represents the rear side of the post-processing device 1, the "left" represents the left side of the post-processing device 1, and the "right" represents the right side of the post-processing device 1 (direction in which the main body of the multifunction peripheral 100 is situated).

As described above, the post-processing device 1 of this embodiment includes the shifting portion 19 (constructed of the regulating guides 191 and the rocking mechanism 192) for shifting the sheet bundle in a direction perpendicular to the delivery direction of the sheet bundle. The shifting portion 19 shifts the sheet bundle corresponding to the same copy to the same position and shifts the sheet bundles to different positions for each copy. The post-processing control portion 10 controls the rocking mechanism 192 to shift the delivery position of the sheet bundle (stack position on the processing tray 15).

Specifically, description is given with reference to FIG. 5. FIG. 5 illustrates the processing tray 15 on the lower side of FIG. 5. When the settings to perform the sorting are performed, the post-processing control portion 10 delivers the sheet bundle from the processing tray 15 while shifting the position of the regulating guides 191 for each copy to the front side (position A) of the post-processing device 1 or the rear side (position B) of the post-processing device 1. After the shift to the position A, the shift to the position B is performed on the succeeding copy, and then the shift to the position A is performed. Thus, the shift to the position A and the shift to the position B are repeated. In order to shift the position of the regulating guides 191, the shifting portion 19 includes, for example, the rocking mechanism 192 (including, for example, a motor and a solenoid).

The sheet bundle is delivered to the delivery tray 17 while being shifted as described above, and hence the delivery positions are offset for each copy. Accordingly, the user can obtain printed copies sorted for each copy. Note that, the number of the shift positions is not limited to two. For example, when the copy is delivered to an intermediate position between the positions A and B as well as the position A and the position B, it is possible to provide three positions for delivery to the delivery tray 17 through the sorting. When the number of stages is further increased, it is possible to provide more positions for the sheet bundle to be delivered to the delivery tray 17.

(Operation of Delivering and Turning Aside Sheet Bundle)

Figure 6:
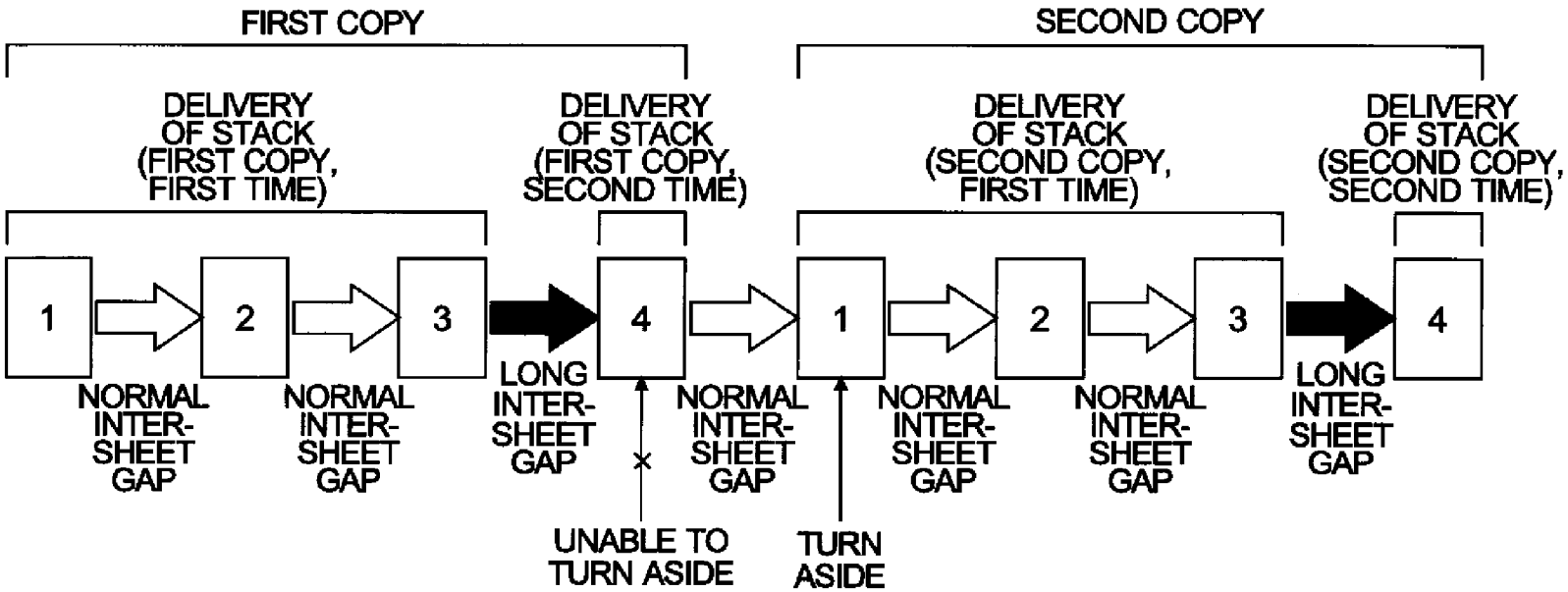
FIG. 6 is an explanatory diagram illustrating an example of an operation of turning aside a sheet in sheet bundle delivery, which is performed by a conventional post-processing device.
Figure 7:
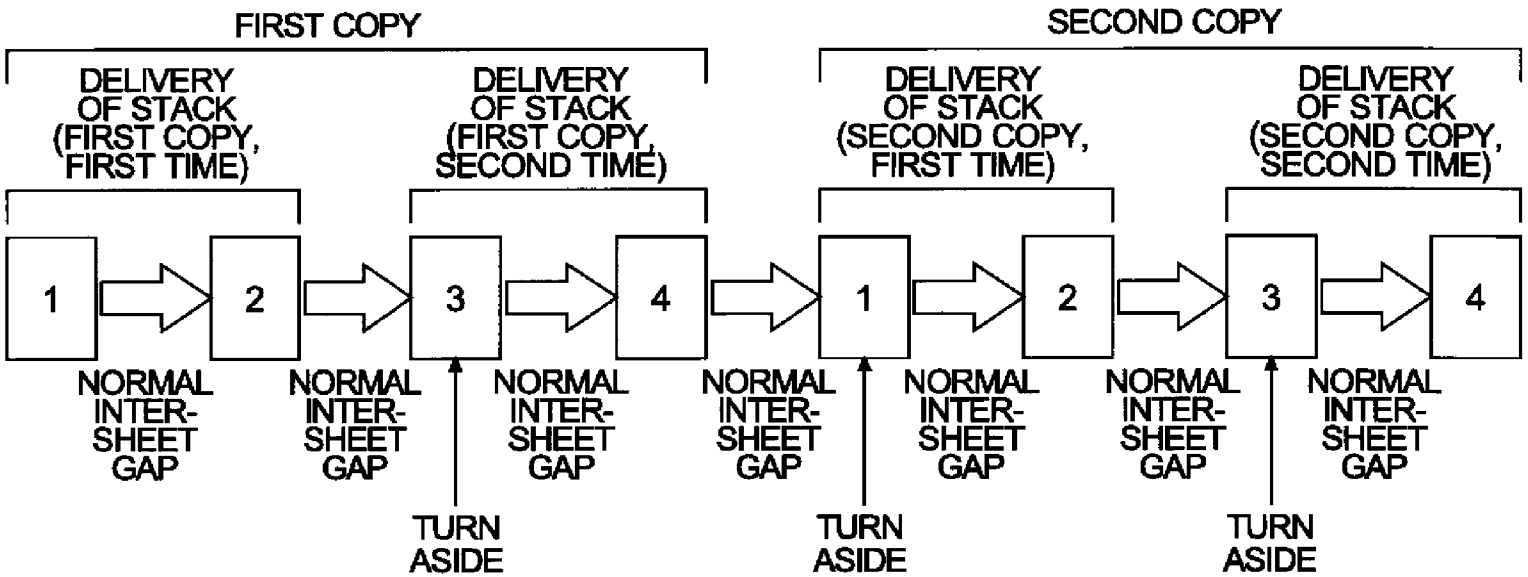
FIG. 7 is an explanatory diagram illustrating an example of an operation of turning aside a sheet in sheet bundle delivery, which is performed by the post-processing device according to an embodiment of the present disclosure.
Figure 8:
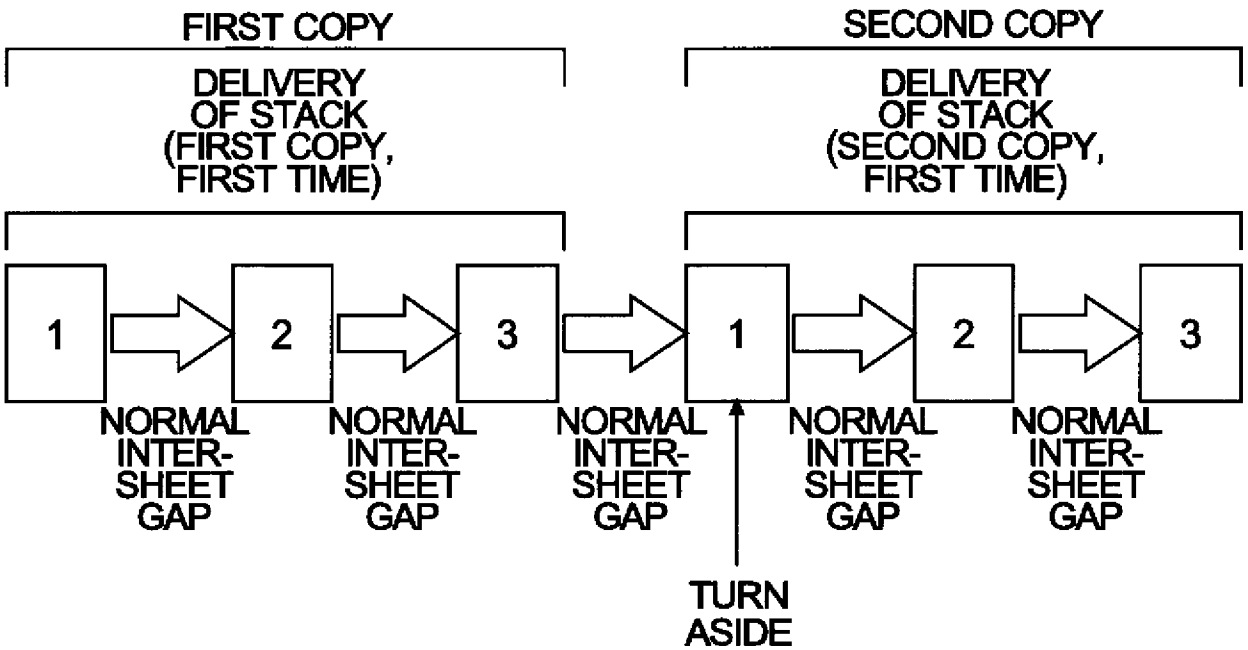
FIG. 8 is an explanatory diagram illustrating another example of the operation of turning aside a sheet in the sheet bundle delivery, which is performed by the post-processing device according to the embodiment of the present disclosure.

Next, reference is made to FIGS. 6 to 8 to describe an operation of delivering and turning aside the sheet bundle, which is performed by the post-processing device 1 of this embodiment. FIG. 6 is an explanatory diagram illustrating an example of an operation of turning aside a sheet in sheet bundle delivery, which is performed by a conventional post-processing device. FIGS. 7 and 8 are explanatory diagrams each illustrating an example of an operation of turning aside a sheet in sheet bundle delivery, which is performed by the post-processing device 1 of this embodiment.

In the following, description is given of delivery of the sheet bundle to be performed when the number of sheets of one copy (remaining number of unstacked sheets) exceeds an amount of sheets (number of sheets) stackable on the processing tray 15. The post-processing device 1 of this embodiment determines whether or not the number of sheets exceeds the maximum stack amount of sheets stackable on the processing tray 15 (predetermined maximum number of stacked sheets).

In the case of copying, the control section 7 is capable of causing the document transport device 2*a* to continuously transport documents to the reading position of the image reading section 2*b*, to thereby continuously read the documents with a plurality of pages. Then, depending on the number of sheets of the documents thus continuously read, the number of sheets of one copy is determined. In addition, a document such as a book may be continuously read on a page basis (for example, image data is temporarily accumulated in the HDD 71), and after all the pages are read, the copying may be started by, for example, depressing the start key 33. As described above, depending on the total number of pages that are read from a bound document such as a book and a handout, the number of sheets of one copy is determined. The operation panel 3 receives an input of designation of the number of copies to be obtained through the copying, when numerals are input by using the numerical keypad portion 34.

Further, in a case where printing is performed as a printer, the control section 7 can be informed of the number of pages of one copy based on the number of pages of image data transmitted from the computer 200 or setting data on printing. Further, the number of print copies may be set by the driver software installed in the computer 200 or an application program for executing the printing. By confirming the data indicating the number of print copies, which is received from the computer 200, the control section 7 can be informed of the number of print copies.

Then, the control section 7 or the engine control portion 50 transmits the number of print copies and the number of pages (total number of sheets) of one copy to the post-processing control portion 10. Accordingly, the post-processing control portion 10 can recognize whether or not the number of sheets of one copy exceeds the maximum number of stacked sheets, and can recognize a timing to shift the shift position (boundary between copies).

Next, reference is made to FIG. 6 to describe an operation of turning aside the sheet and delivering the sheet bundle to be performed by the conventional post-processing device when the remaining number of unstacked sheets is larger by one sheet than the maximum number of stacked sheets of the processing tray. Note that, in the following, for convenience of the description, there is taken an example in which the maximum number of stacked sheets of the processing tray of the conventional post-processing device is three, and the number of sheets of one copy is larger by one sheet than the maximum number of stacked sheets of the processing tray (four sheets in one copy). Note that, the processing tray is generally capable of stacking a predetermined number of sheets that can be stapled (for example, several pages up to 20 or 30 pages, approximately).

First, when the number of sheets of one copy is larger than the maximum number of stacked sheets of the processing tray at the time of sorting, the sheet bundles need to be delivered one or more times in the midway of one copy. When a sheet to be stacked on the processing tray for the first time is turned aside after the sheet bundle is delivered, the normal inter-sheet gap can be maintained to perform the printing and sheet transport with no need to provide a waiting time during the printing. In other words, it is possible to prevent the arrival of the sheet at the processing tray that is not ready for stacking during the delivery processing.

However, for example, when the number of sheets of one copy is larger by one sheet than the maximum number of stacked sheets of the processing tray 15 at the time of the sorting, the last page of the one copy cannot be turned aside. This point is described with reference to FIG. 6. For example, FIG. 6 illustrates a relationship between the inter-sheet gap and the operation of delivering and turning aside the sheet bundle in the conventional post-processing device in a case where the maximum number of stacked sheets of the processing tray is three, whereas the number of sheets of one copy is four.

Conventionally, when the number of sheets of one copy is larger by one sheet than the maximum number of stacked sheets of the processing tray (when the remaining number of unstacked sheets is larger by one sheet than the maximum number of stacked sheets of the processing tray), the sheets are to be stacked on the processing tray up to the maximum number of stacked sheets. In the example of FIG. 6, up to three sheets are to be stacked on the processing tray for each copy. After the sheets are stacked up to the maximum number of stacked sheets, the sheet bundle is delivered.

As described above, the last page of one copy cannot be turned aside. In this case, the sheets are continuously delivered, and hence when the last page of the one copy is turned aside, the last page of the one copy overlaps the first page of the succeeding copy, or the last page of the one copy becomes too close to the first page of the succeeding copy, and as a result, the last page of the one copy and the first page of the succeeding copy arrive at the processing tray substantially simultaneously. Consequently, different copies cannot be delivered while being shifted to different positions. Note that, as illustrated in FIG. 6, there is no problem even when the first page of the succeeding copy is turned aside.

Therefore, conventionally, when the number of sheets of one copy is larger by one sheet than the maximum number of stacked sheets of the processing tray, in order to ensure the period of time for delivery of the sheet bundle, as illustrated in FIG. 6, the inter-sheet gap between the last page and the page preceding the last page is set larger than the normal case. Specifically, the timings for the sheet feeding, toner image formation, and transfer to the sheet are delayed by about a period of time required for the shift of the last page and the delivery (for example, about one second). However, such delay in timings may cause decrease in productivity of the multifunction peripheral and the post-processing device.

As the number of print copies increases, the conventional post-processing device takes a longer period of time to deliver the last sheet. For example, in a case of 10 copies, it may take about 10 seconds as a delay period, and in a case of 100 copies, it may take about 100 seconds as a delay period.

Therefore, the post-processing device 1 of this embodiment delivers the sheet bundle at a timing at which the number of stacked sheets is smaller by one or more sheets than the maximum number of stacked sheets, to thereby prevent the delivery of only the sheet on the last page of one copy. Specifically, in the post-processing device 1 of this embodiment, the post-processing control portion 10 causes the delivery mechanism 16 to deliver the sheet bundle when the number of sheets stacked on the processing tray 15 is smaller by one sheet than the maximum number of stacked sheets. This point is described with reference to FIG. 7.

First, similarly to the example of FIG. 6, FIG. 7 illustrates as an example a relationship between the inter-sheet gap and the operation of delivering and turning aside the sheet bundle in a case where the maximum number of stacked sheets of the processing tray 15 according to this embodiment is three, whereas the number of sheets of one copy is four. In this embodiment, the post-processing control portion 10 causes the delivery mechanism 16 to temporarily deliver the sheets when the sheet on the second page of one copy is stacked (at the time of "(maximum number of stacked sheets)-1"). Then, the post-processing control portion 10 turns aside the first sheet to be stacked on the processing tray 15 to the turn-aside portion 14 (in the example of FIG. 7, third page). Accordingly, it is possible to ensure a period of time for delivery of the sheets on the first page and the second page of one copy (first half of one copy). Then, in order to ensure a period of time for delivery of the third page and the fourth page (last page) of one copy, the post-processing control portion 10 turns aside the first page of the succeeding copy (second copy) to the turn-aside portion 14.

Accordingly, it is possible to deliver the sheets to the delivery tray 17 while performing the sorting with no delay, without increasing the inter-sheet gap between any pages as compared to the normal case even when the remaining number of unstacked sheets is larger by one sheet than the maximum number of stacked sheets of the processing tray 15 (for example, even when the number of sheets of one copy is larger by one sheet than the maximum number of stacked sheets of the processing tray 15).

Note that, the post-processing control portion 10 of this embodiment causes the delivery mechanism 16 to deliver the sheet bundle when the number of stacked sheets is smaller by one sheet than the maximum number of stacked sheets of the processing tray 15. However, when the remaining number of sheets of one copy stacked on the processing tray 15 is equal to the maximum number of stacked sheets of the processing tray 15, the above-mentioned delivery operation in turn causes the delivery of only the sheet on the last page. Therefore, when the remaining number of sheets of one copy stacked on the processing tray 15 is equal to the maximum number of stacked sheets of the processing tray 15, the post-processing control portion 10 prevents the delivery mechanism 16 from delivering the sheet bundle under a state in which the number of stacked sheets is smaller by one sheet than the maximum number of stacked sheets of the processing tray 15. In other words, the post-processing control portion 10 causes the delivery mechanism 16 to deliver the sheet bundle after the sheets are accumulated up to the maximum number of stacked sheets of the processing tray 15.

This point is described with reference to FIG. 8. Similarly to the examples of FIGS. 6 and 7, FIG. 8 illustrates an example in which the maximum number of stacked sheets of the processing tray 15 is three. Further, FIG. 8 illustrates a relationship between the inter-sheet gap and the operation of delivering and turning aside the sheet bundle in a case where the number of sheets of one copy is three.

As illustrated in FIG. 8, when the remaining number of sheets of one copy is equal to the maximum number of stacked sheets of the processing tray 15, the post-processing control portion 10 causes the delivery mechanism 16 to deliver the sheet bundle while causing the shifting portion 19 to perform the shift after the sheets are stacked on the processing tray 15 up to the maximum number of stacked sheets. Further, the post-processing control portion 10 causes the switching claw 142 to operate so that the first page of the succeeding copy is turned aside to the turn-aside portion 14. Accordingly, the inter-sheet gap between all the sheets is not increased and maintained as in the normal case, with the result that the productivity is maintained.

(Control Flow of Sorting)

Figure 9:
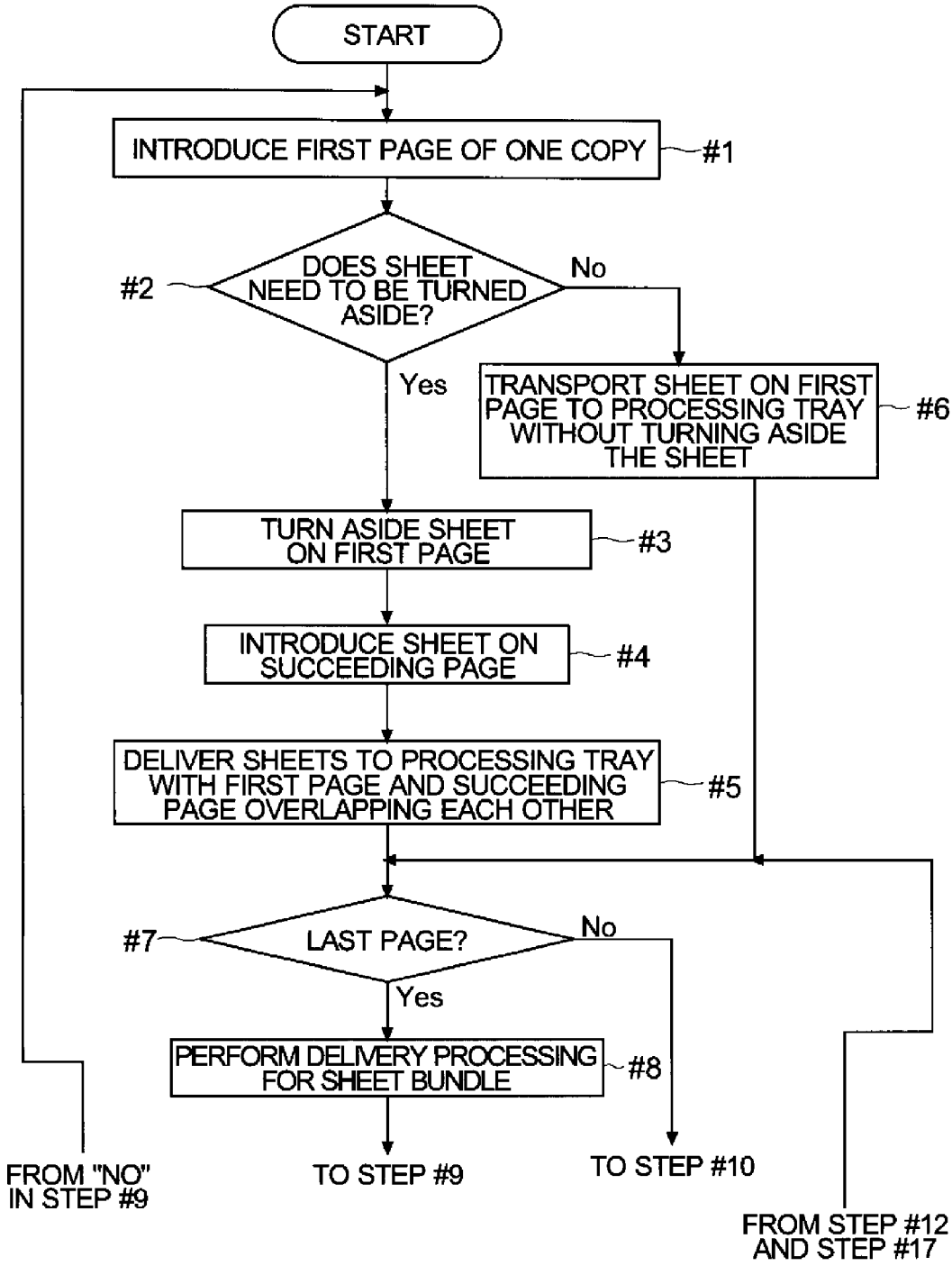
FIG. 9 is a flowchart illustrating an example of a flow of sorting processing, which is performed by the post-processing device according to the embodiment of the present disclosure.
Figure 10:
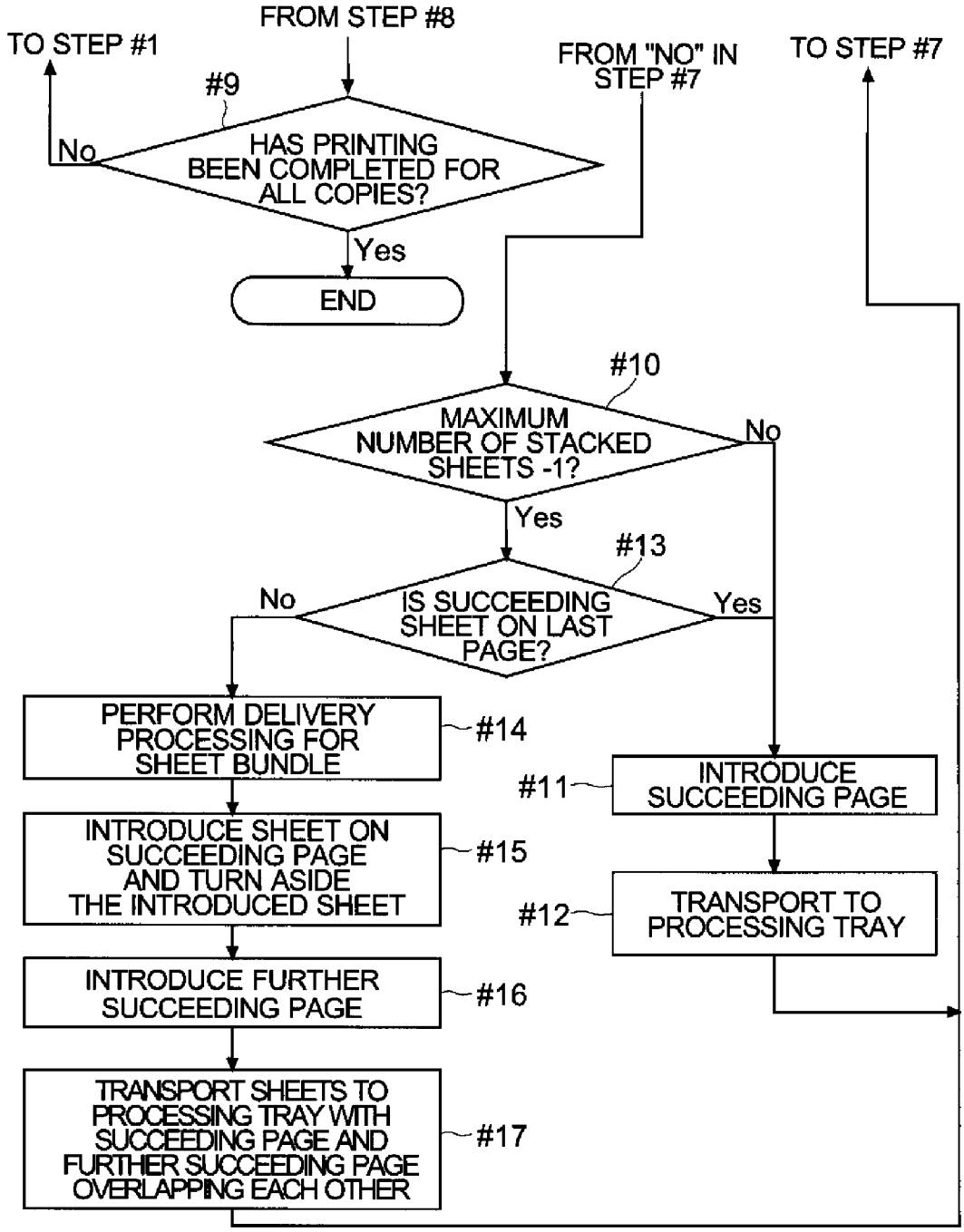
FIG. 10 is a flowchart illustrating the example of the flow of the sorting processing, which is performed by the post-processing device according to the embodiment of the present disclosure.

Next, reference is made to FIGS. 9 and 10 to describe an example of a flow of the sorting processing, which is performed by the post-processing device 1 of this embodiment. FIGS. 9 and 10 are flowcharts each illustrating an example of the flow of the sorting processing, which is performed by the post-processing device 1 of this embodiment. Note that, the series of flow is long and hence divided into two sections in FIGS. 9 and 10.

Note that, unless the number of sheets of one copy exceeds the maximum number of stacked sheets, when the sheet bundle is delivered after the sheet on the last page of the one copy is stacked on the processing tray 15, and the sheet on the first page of the succeeding copy is turned aside to the turn-aside portion 14, the sorting processing can be performed without increasing the inter-sheet gap to maintain the inter-sheet gap as in the normal case. Therefore, in the following, description is given of a flow of the sorting processing to be performed when the number of sheets of one copy exceeds the maximum number of stacked sheets.

First, the flow of FIG. 9 starts when the multifunction peripheral 100 prints a plurality of copies and the post-processing device 1 performs the sorting processing. For example, the time to start the flow corresponds to a time when printing of a plurality of copies is instructed while the sorting processing is set on the operation panel 3, and a time when the I/F section 72 receives an instruction to print a plurality of copies and an instruction to perform the sorting processing from the computer 200. Note that, the sorting is performed and hence it is assumed that a plurality of pages are included in one copy and a plurality of copies are printed.

Based on the output from the introduction sensor 121, the post-processing control portion 10 recognizes the introduction of a sheet on the first page of a copy printed in the main body of the multifunction peripheral 100 (Step #1). Then, the post-processing control portion 10 confirms whether or not the sheet on the first page of the copy needs to be turned aside (Step #2). Specifically, in a case of the first copy, there is no need to turn aside the sheet, and in a case of the second or subsequent copy, it is necessary to turn aside the sheet so as to deliver the sheet bundle corresponding to the preceding copy.

When the sheet needs to be turned aside ("Yes" in Step #2), the post-processing control portion 10 turns aside the introduced sheet on the first page to the turn-aside portion 14 (Step #3). Subsequently, the post-processing control portion 10 recognizes the introduction of the sheet on the succeeding page (Step #4). At this time, the sheet on the first page and the sheet on the succeeding page (second page) overlap each other when delivered to the processing tray 15 (Step #5). On the other hand, when the sheet does not need to be turned aside ("No" in Step #2), the post-processing control portion 10 delivers the introduced sheet on the first page to the processing tray 15 without turning aside the sheet to the turn-aside portion 14 (Step #6).

After Step #5 or #6, the post-processing control portion 10 confirms whether or not the stacked sheet is on the last page of the copy in the post-processing (Step #7). Note that, by the time of Step #7, the post-processing control portion 10 has received, from the engine control portion 50 or the control section 7, data indicating the number of sheets (number of pages) of one copy and the number of print copies. The post-processing control portion 10 recognizes the number of sheets of one copy and the number of print copies in advance. When the stacked sheet is on the last page ("Yes" in Step #7), it is necessary to deliver the sheet bundle on the processing tray 15 while performing the sorting. Therefore, the post-processing control portion 10 causes the shifting portion 19 to shift the sheet bundle, and then causes the delivery mechanism 16 to deliver the sheet bundle to the delivery tray 17 (delivery processing for the sheet bundle: Step #8).

Along with the delivery processing for the sheet bundle, the post-processing control portion 10 confirms whether or not printing has been completed for all the copies (Step #9). When the post-processing has been completed for the sheets of all the copies ("Yes" in Step #9), the sorting processing has been completed and hence this flow is finished ("End"). On the other hand, when any copy remains for the post-processing ("No" in Step #9), the flow returns to Step #1.

When the stacked sheet is not on the last page in Step #7 ("No" in Step #7), the post-processing control portion 10 confirms whether or not the number of sheets stacked on the processing tray 15 satisfies the condition of "(maximum number of stacked sheets)-1" (Step #10). When the number of sheets stacked on the processing tray 15 does not satisfy the condition of "(maximum number of stacked sheets)-1" ("No" in Step #10), the post-processing control portion 10 recognizes the introduction of a sheet on the succeeding page (Step #11). Further, the post-processing control portion 10 transports the introduced sheet toward the processing tray 15 (Step #12). Then, the flow returns to Step #7.

On the other hand, when the number of sheets stacked on the processing tray 15 satisfies the condition of "(maximum number of stacked sheets)-1" ("Yes" in Step #10), the post-processing control portion 10 confirms whether or not the succeeding sheet to be stacked on the processing tray 15 (sheet on the succeeding page) is on the last page of one copy (Step #13). When the succeeding sheet to be stacked on the processing tray 15 (sheet on the succeeding page) is on the last page of one copy ("Yes" in Step #13), the flow proceeds to Step #11 so as to avoid the delivery of only the sheet on the last page. In this case, after the flow finally returns from Step #12 to Step #7, the sheet bundle is delivered. In other words, as described with reference to FIG. 8, when the remaining number of sheets of one copy is equal to the maximum number of stacked sheets of the processing tray 15, the post-processing control portion 10 causes the delivery mechanism 16 to deliver the sheet bundle while causing the shifting portion 19 to perform the shift after the sheets are stacked on the processing tray 15 up to the maximum number of stacked sheets.

On the other hand, when the succeeding sheet to be stacked on the processing tray 15 (sheet on the succeeding page) is not on the last page of one copy ("No" in Step #13), the post-processing control portion 10 causes the shifting portion 19 to shift the sheet bundle, and then causes the delivery mechanism 16 to perform the delivery processing of delivering the sheet bundle to the delivery tray 17 (Step #14).

Then, the post-processing control portion 10 recognizes the introduction of a sheet on the succeeding page, and turns aside the introduced sheet on the succeeding page to the turn-aside portion 14 (Step #15). The succeeding page is not the last page, and hence the post-processing control portion 10 further recognizes the introduction of a sheet on a page further succeeding the introduced sheet on the succeeding page (Step #16). Then, the introduced sheet on the succeeding page and the sheet on the page further succeeding the introduced sheet on the succeeding page overlap each other when delivered to the processing tray 15 (Step #17). Steps #15 to #17 correspond to processing of turning aside the sheet on the first page to be stacked on the processing tray 15 after delivering the sheet bundle, so as not to increase the inter-sheet gap as compared to the normal case even when the sheet bundle is delivered in the midway of the copy. Then, the flow returns to Step #7.

As described above, the post-processing device 1 of this embodiment includes the processing tray 15 on which sheets are to be stacked, the transport portion 11 for transporting, toward the processing tray 15, a sheet introduced through the introduction port 12, the turn-aside portion 14 provided in the midway of the transport path of the transport portion 11, for turning aside the sheet to delay the arrival of the sheet at the processing tray 15, and then sending out the sheet to the processing tray 15, and the delivery mechanism 16 for delivering the sheets stacked on the processing tray 15 to the delivery tray 17 on a boundary between copies. When the remaining number of sheets of one copy unstacked on the processing tray 15 exceeds the maximum number of stacked sheets that is an amount of sheets stackable on the processing tray 15, the delivery mechanism 16 delivers the sheet bundle corresponding to one copy a plurality of times so as to avoid delivery of only one sheet on the last page of the one copy, and the turn-aside portion 14 turns aside a sheet on the first page to be stacked on the processing tray 15 after delivering the sheet bundle.

Accordingly, when the respective copies that are continuously printed are sorted, the delivery of only the sheet on the last page of the one copy is avoided. Thus, the inter-sheet gap does not need to be increased (the normal inter-sheet gap is maintained) so as to delay the arrival of the last page that cannot be turned aside at the processing tray 15 and to ensure the period of time for delivery of the sheet bundle. Further, even when the sheet bundle is delivered in the midway of one copy because the number of sheets of one copy exceeds the maximum number of stacked sheets of the processing tray 15, the turn-aside portion 14 turns aside the succeeding sheet on the first page to be stacked on the processing tray 15, and hence the inter-sheet gap is maintained as in the normal case and thus does not need to be increased. Further, the first page of the succeeding copy is turned aside also when the sheet bundle is delivered on the boundary between copies, and hence the inter-sheet gap does not need to be increased even when the sheet bundle is delivered on the boundary between copies. Thus, there is no need to increase the inter-sheet gap for delivery of the sheet bundle unlike the conventional post-processing device 1, and hence it is possible to maintain the productivity of the post-processing device 1 without decreasing the productivity irrespective of the number of sheets of one copy. Note that, the maximum number of stacked sheets is determined in advance in consideration of the size of the processing tray 15 and the specification of the post-processing device 1.

Further, the delivery mechanism 16 delivers the sheet bundle when the number of sheets stacked on the processing tray 15 is smaller by one sheet than the maximum number of stacked sheets. Accordingly, it is possible to reliably minimize the number of times of delivery of the sheet bundle for one copy.

Further, when the remaining number of sheets of the sheet bundle corresponding to one copy to be stacked on the processing tray 15 is equal to the maximum number of stacked sheets, the delivery mechanism 16 delivers the sheet bundle when the sheets are stacked on the processing tray 15 up to the maximum number of stacked sheets. Accordingly, it is possible to prevent the delivery of only the sheet on the last page. Further, it is possible to minimize the number of times of delivery of the sheet bundle for one copy.

Further, the shifting portion 19 is provided so as to shift the sheet bundle in the direction perpendicular to the delivery direction of the sheet bundle. The shifting portion 19 shifts the sheet bundle corresponding to the same copy to the same position and shifts the sheet bundles to different positions for each copy. Accordingly, it is possible to sort the respective copies by shifting the delivery position at the delivery tray 17.

Further, the image forming apparatus of this embodiment (for example, the multifunction peripheral 100) includes the post-processing device 1 of this embodiment. Accordingly, unlike the conventional case, in the image forming apparatus, irrespective of the number of sheets of one copy, the inter-sheet gap does not need to be increased (the normal inter-sheet gap is maintained) so as to delay the arrival of the last page that cannot be turned aside at the processing tray 15 and to ensure the period of time for delivery of the sheet bundle. Thus, it is possible to provide the image forming apparatus (for example, the multifunction peripheral 100) with no decrease in productivity.

Next, another example of the embodiment is described. In the above-mentioned embodiment, there has been described the example in which, in the case where the remaining number of sheets unstacked on the processing tray 15 exceeds the maximum number of stacked sheets, the delivery mechanism 16 delivers the sheet bundle when the number of sheets stacked on the processing tray 15 is smaller by one sheet than the maximum number of stacked sheets (at the time of "(maximum number of stacked sheets)--1"). However, the condition of "(maximum number of stacked sheets)−1" may be replaced with a condition of "(maximum number of stacked sheets)−2 or more".

Note that, even when the condition of "(maximum number of stacked sheets)−2 or more" is set, in order to minimize the delivery of the sheet bundle without performing the delivery of the sheet bundle too frequently, an integer obtained by rounding up a value obtained by dividing the number of sheets of one copy by the maximum number of stacked sheets may be set as a limit number of times of delivery of the sheet bundle corresponding to one copy, to thereby deliver the sheet bundle corresponding to one copy a plurality of times. That is, the delivery mechanism 16 delivers the sheet bundle so that the integer obtained by rounding up the value obtained by dividing the number of sheets of one copy by the maximum number of stacked sheets becomes the number of times of delivery of the sheet bundle corresponding to one copy. Accordingly, it is possible to minimize the number of times of delivery of the sheet bundle corresponding to one copy.

Further, in the above-mentioned embodiment, there has been described the example in which the maximum stack amount of sheets stackable on the processing tray 15 is predefined as the maximum number of stacked sheets. Here, the maximum number of stacked sheets is not fixed but may be varied depending on settings on the thickness of the sheet to be used for the printing, which are performed on the operation panel. For example, the thickness of the sheet to be used for the printing may be selected and set on the operation panel 3 in about three stages of thick paper, plain paper, and thin paper. Further, for example, data defining the maximum number of stacked sheets corresponding to the thickness of the sheet is prestored in the storage portion or the memory inside the post-processing device, for storing setting data. Then, the post-processing control portion 10 receives, from the control section 7 or the engine control portion 50, data indicating the thickness of the sheet. In response thereto, the post-processing control portion 10 may vary the maximum number of stacked sheets depending on the thickness of the sheet.

Further, in the above-mentioned embodiment, there has been described the example in which the maximum stack amount of sheets stackable on the processing tray 15 is predefined as the maximum number of stacked sheets. Alternatively, a sensor (for example, an optical sensor) may be provided so as to detect the thickness of the sheet stacked on the processing tray, and based on the output from the sensor, the post-processing control portion 10 may recognize whether the current sheet bundle amount of the processing tray 15 corresponds to the maximum number of stacked sheets or the state of "(maximum number of stacked sheets)-1". Further, the post-processing control portion 10 may determine, based on the output from the sensor, whether or not the remaining number of sheets unstacked on the processing tray 15 exceeds the maximum number of stacked sheets that is an amount of sheets stackable on the processing tray 15.

The embodiment of the present disclosure has been described above, but the scope of the present disclosure is not limited thereto, and various modifications may be made to embody the present disclosure without departing from the gist of the present disclosure.

What is claimed is:

1. A post-processing device, comprising:

a processing tray on which sheets are to be stacked;

a transport portion for transporting, toward the processing tray, a sheet introduced through an introduction port;

a delivery mechanism for delivering the sheets stacked on the processing tray to a delivery tray on a boundary between copies;

a turn-aside portion for turning aside the sheet to delay arrival of the sheet at the processing tray, and then sending out the sheet to the processing tray; and a control portion, wherein, when a remaining number of sheets of one copy unstacked on the processing tray exceeds a maximum number of stacked sheets that is an amount of sheets stackable on the processing tray, the control portion makes the delivery mechanism deliver a sheet bundle corresponding to the one copy a plurality of times so as to avoid delivery of only one sheet on a last page of the one copy, and the control portion makes the transport portion transport toward the turn-aside portion a sheet on a first page to be stacked on the processing tray after delivering the sheet bundle so that the turn-aside portion turns aside the sheet on the first page to be stacked on the processing tray after delivering the sheet bundle in order to delay arrival of the sheet at the processing tray and then send out the sheet that has been turned aside to the processing tray.

2. A post-processing device according to claim 1, wherein the control portion makes the delivery mechanism deliver the sheet bundle when a number of the sheets stacked on the processing tray is smaller by one sheet than the maximum number of stacked sheets.

3. A post-processing device according to claim 1, wherein, when the remaining number of sheets of the sheet stack of the one copy to be stacked on the processing tray is equal to the maximum number of stacked sheets, the control portion makes the delivery mechanism deliver the sheet bundle when the sheets are stacked on the processing tray up to the maximum number of stacked sheets.

4. A post-processing device according to claim 1, further comprising a shifting portion for shifting the sheet bundle in a direction perpendicular to a delivery direction of the sheet bundle, the shifting portion being configured to shift a sheet bundle of the same copy to the same position and shift sheet bundles to different positions for each copy.

5. A post-processing device according to claim 1, wherein the control panel makes the delivery mechanism deliver the sheet bundle so that an integer obtained by rounding up a value obtained by dividing a number of sheets of the one copy by the maximum number of stacked sheets becomes a number of times of delivery of the sheet bundle corresponding to the one copy.

6. An image forming apparatus, comprising the post-processing device according to claim 1.

7. A control method for a post-processing device, comprising the steps of:

transporting a sheet toward a processing tray;

stacking the sheet on the processing tray;

delivering the sheet stacked on the processing tray to a delivery tray on a boundary between copies;

delivering, when a remaining number of sheets of one copy unstacked on the processing tray exceeds a maximum number of stacked sheets that is an amount of sheets stackable on the processing tray, a sheet bundle corresponding to the one copy from the processing tray a plurality of times so as to avoid delivery of only one sheet on a last page of the one copy;

turning aside the sheet to delay arrival of the sheet at the processing tray, and then sending out the sheet to the processing tray; and turning aside, when the remaining number of sheets of the one copy unstacked on the processing tray exceeds the maximum number of stacked sheets, a sheet on a first page to be stacked on the processing tray after delivering the sheet bundle.

8. A control method for a post-processing device according to claim 7, further comprising delivering the sheet bundle when a number of the sheets stacked on the processing tray is smaller by one sheet than the maximum number of stacked sheets.

9. A control method for a post-processing device according to claim 7, further comprising delivering, when the remaining number of sheets of the sheet stack of the one copy to be stacked on the processing tray is equal to the maximum number of stacked sheets, the sheet bundle when the sheets are stacked on the processing tray up to the maximum number of stacked sheets.

10. A control method for a post-processing device according to claim 7, further comprising shifting the sheet bundle in a direction perpendicular to a delivery direction of the sheet bundle, wherein the shifting comprises shifting a sheet bundle of the same copy to the same position and shifting sheet bundles to different positions for each copy.

11. A control method for a post-processing device according to claim 7, further comprising delivering the sheet bundle so that an integer obtained by rounding up a value obtained by dividing a number of sheets of the one copy by the maximum number of stacked sheets becomes a number of times of delivery of the sheet bundle corresponding to the one copy.

* * * * *